US010643539B2

(12) United States Patent
Yang et al.

(10) Patent No.: US 10,643,539 B2
(45) Date of Patent: May 5, 2020

(54) COMPENSATION PIXEL CIRCUIT, DISPLAY PANEL, DISPLAY APPARATUS, COMPENSATION METHOD AND DRIVING METHOD

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN); Dongni Liu, Beijing (CN); Lei Wang, Beijing (CN); Li Xiao, Beijing (CN); Han Yue, Beijing (CN); Pengcheng Lu, Beijing (CN); Jie Fu, Beijing (CN); Yingming Liu, Beijing (CN); Can Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 42 days.

(21) Appl. No.: 15/562,513

(22) PCT Filed: Mar. 16, 2017

(86) PCT No.: PCT/CN2017/076917
§ 371 (c)(1),
(2) Date: Sep. 28, 2017

(87) PCT Pub. No.: WO2018/028198
PCT Pub. Date: Feb. 15, 2018

(65) Prior Publication Data

US 2018/0357960 A1 Dec. 13, 2018

(30) Foreign Application Priority Data

Aug. 12, 2016 (CN) ..... 201610664473

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3208; G09G 3/3233; G09G 3/3258; G09G 2320/045
See application file for complete search history.

(56) References Cited

U.S. PATENT DOCUMENTS 6,970,149 B2 * 11/2005 Chung ..... G09G 3/3233 315/169.3
8,026,873 B2 * 9/2011 Leon ..... G09G 3/3291 315/169.3
(Continued)

FOREIGN PATENT DOCUMENTS

CN 103000134 A 3/2013
CN 103500556 A 1/2014
(Continued)

OTHER PUBLICATIONS

Korean Office Action in Korean Application No. 10-2017-7029231, dated Aug. 28, 2018 with English translation.
(Continued)

*Primary Examiner* — Gene W Lee
(74) *Attorney, Agent, or Firm* — Collard & Roe, P.C.

(57) ABSTRACT

A compensation pixel circuit, a display panel, a display apparatus, a regional compensation method and a driving method are provided. The compensation pixel circuit includes a compensation driving circuit and a signal acquiring circuit connected with the compensation driving circuit.
(Continued)

The compensation driving circuit includes a driving transistor and an organic light-emitting diode. The compensation driving circuit is configured to receive a light-emitting data signal, compensate a threshold voltage of the driving transistor, and drive the organic light-emitting diode to illuminate in accordance with the light-emitting data signal. The signal acquiring circuit is configured to acquire a gate voltage of the driving transistor.

17 Claims, 8 Drawing Sheets

(51) Int. Cl.
*G09G 3/36* (2006.01)
*G09G 3/3266* (2016.01)

(52) U.S. Cl.
CPC ..... *G09G 3/3659* (2013.01); *G09G 2300/043* (2013.01); *G09G 2300/0426* (2013.01); *G09G 2300/0819* (2013.01); *G09G 2300/0842* (2013.01); *G09G 2300/0861* (2013.01); *G09G 2310/0251* (2013.01)

(56) References Cited

U.S. PATENT DOCUMENTS

| | | | | |
|---|---|---|---|---|
| 8,274,503 | B2 * | 9/2012 | Kwon | G09G 3/3233 345/214 |
| 9,734,763 | B2 | 8/2017 | Sun | |
| 10,140,903 | B2 * | 11/2018 | Lee | G09G 3/3233 |
| 10,163,393 | B2 | 12/2018 | Yang et al. | |
| 2006/0208971 | A1 | 9/2006 | Deane | |
| 2009/0027377 | A1 * | 1/2009 | Kwon | G09G 3/3233 345/214 |
| 2009/0051628 | A1 | 2/2009 | Kwon | |
| 2014/0175992 | A1 | 6/2014 | Yang | |
| 2015/0170565 | A1 | 6/2015 | Hong et al. | |
| 2015/0287360 | A1 | 10/2015 | Yin et al. | |
| 2015/0364085 | A1 * | 12/2015 | Kanda | G09G 3/3233 345/214 |
| 2016/0155385 | A1 | 6/2016 | Yang | |
| 2016/0284274 | A1 | 9/2016 | Tan et al. | |
| 2017/0154576 | A1 | 6/2017 | Sun | |
| 2017/0162120 | A1 * | 6/2017 | Hung | G09G 3/3233 |
| 2017/0263186 | A1 | 9/2017 | Wang et al. | |
| 2018/0018916 | A1 | 1/2018 | Chung | |

FOREIGN PATENT DOCUMENTS

| | | | |
|---|---|---|---|
| CN | 104123912 | A | 10/2014 |
| CN | 104134426 | A | 11/2014 |
| CN | 104318898 | A | 1/2015 |
| CN | 105023539 | A | 11/2015 |
| CN | 105118442 | A | 12/2015 |
| CN | 105243986 | A | 1/2016 |
| CN | 106097962 | A | 11/2016 |
| KR | 10-2015-0141368 | A | 12/2015 |
| WO | 2016/074418 | A1 | 5/2016 |

OTHER PUBLICATIONS

International Search Report of PCT/CN2017/076917 in Chinese, dated May 31, 2017 with English translation.
Notice of Transmittal of the International Search Report of PCT/CN2017/076917 in Chinese, dated May 31, 2017.
Written Opinion of the International Searching Authority of PCT/CN2017/076917 in Chinese, dated May 31, 2017 with English translation.
Ohinese Office Action in Chinese Application No. 201610664473.0, dated Apr. 24, 2019 with English translation.
Chinese Office Action in Chinese Application No. 201610664473.0, dated Sep. 27, 2019 with English translation.
Extended European Search Report in EP Application No. 17771325.2 dated Feb. 7, 2020.

* cited by examiner

COMPENSATION PIXEL CIRCUIT, DISPLAY PANEL, DISPLAY APPARATUS, COMPENSATION METHOD AND DRIVING METHOD

CROSS REFERENCE TO RELATED APPLICATIONS

This application is the National Stage of PCT/CN2017/076917 filed on Mar. 16, 2017, which claims priority under 35 U.S.C. § 119 of Chinese Application No. 201610664473.0 filed on Aug. 12, 2016, the disclosure of which is incorporated by reference.

TECHNICAL FIELD

Embodiments of the present disclosure relate to a compensation pixel circuit, a display panel, a display apparatus, a regional compensation method and a driving method.

BACKGROUND

In the field of display, organic light-emitting diode (OLED) display panels have such advantages as self-illumination, high contrast, large visual angle, fast response, availability as a flexible panel, large range of applicable temperatures, simple fabrication process and the like, and have attracted a broad development prospect.

Owing to the above-mentioned characteristics, organic light-emitting diode (OLED) display panels may be applicable to mobile phones, displays, notebook computers, digital cameras, instruments and meters, or other devices with display functionality.

SUMMARY

An embodiment of the present disclosure provides a compensation pixel circuit, comprising: a compensation driving circuit, comprising a driving transistor and an organic light-emitting diode, wherein the compensation driving circuit is configured to receive a light-emitting data signal, compensate a threshold voltage of the driving transistor, and drive the organic light-emitting diode to illuminate in accordance with the light-emitting data signal; and a signal acquiring circuit connected with the compensation driving circuit and configured to acquire a gate voltage of the driving transistor.

For example, in the compensation pixel circuit of an embodiment of the present disclosure, the signal acquiring circuit is electrically connected to the driving transistor.

For example, in the compensation pixel circuit of an embodiment of the present disclosure, the compensation driving circuit further comprises a first transistor, a second transistor, a third transistor, a fourth transistor, a fifth transistor, and a storage capacitor.

For example, in the compensation pixel circuit of an embodiment of the present disclosure, a first electrode of the first transistor is electrically connected to a first power line to receive a first voltage, a gate of the first transistor and a gate of the fifth transistor are electrically connected to a second scanning signal line to receive a second scanning signal, and a second electrode of the first transistor is electrically connected to a first node; a first electrode of the second transistor is electrically connected to a light-emitting data signal line to receive the light-emitting data signal, a gate of the second transistor and a gate of the fourth transistor are electrically connected to a first scanning signal line to receive a first scanning signal, and a second electrode of the second transistor is electrically connected to the first node; a first electrode of the third transistor is electrically connected to a second power line to receive a second voltage, a gate of the third transistor is electrically connected to a control signal line to receive a control signal, and a second electrode of the third transistor is electrically connected to a second node; a first electrode of the fourth transistor is electrically connected to the second node, and a second electrode of the fourth transistor is electrically connected to a third node; a first electrode of the fifth transistor is electrically connected to the third node and a second electrode of the fifth transistor is electrically connected to a first electrode of the organic light-emitting diode; a second electrode of the organic light-emitting diode is connected to ground; a first electrode of the driving transistor is electrically connected to the first node, a gate of the driving transistor is electrically connected to the second node, and a second electrode of the driving transistor is electrically connected to the third node; and a first terminal of the storage capacitor is electrically connected to the second power line and a second terminal of the storage capacitor is electrically connected to the second node.

For example, in the compensation pixel circuit of an embodiment of the present disclosure, the second power line is connected to ground.

For example, in the compensation pixel circuit of an embodiment of the present disclosure, the first transistor, the second transistor, the third transistor, the fourth transistor and the fifth transistor are all p-type transistors.

For example, in the compensation pixel circuit of an embodiment of the present disclosure, the first transistor, the second transistor, the third transistor, the fourth transistor and the fifth transistor are all thin film transistors.

For example, the compensation pixel circuit of an embodiment of the present disclosure further comprising a compensation controller, wherein the compensation controller is configured to receive the gate voltage of the driving transistor acquired by the signal acquiring circuit.

For example, in the compensation pixel circuit of an embodiment of the present disclosure, the compensation controller is further configured to: receive the light-emitting data signal received by the compensation driving circuit, subtract a light-emitting voltage in the light-emitting data signal received by the compensation driving circuit from the gate voltage of the driving transistor to obtain the threshold voltage of the driving transistor.

An embodiment of the present disclosure provides a display panel, comprising the compensation pixel circuit of any one embodiment of the present disclosure.

For example, the display panel of an embodiment of the present disclosure further comprises a plurality of compensation regions, wherein each of the plurality of compensation regions comprises at least one of the compensation pixel circuit.

For example, in the display panel of an embodiment of the present disclosure, each of the compensating regions further comprises non-compensation pixel circuits, and sub-pixel areas occupied by the non-compensation pixel circuits are adjacent to a sub-pixel area occupied by the compensation pixel circuit.

For example, the display panel of an embodiment of the present disclosure further comprises a compensation controller, wherein the compensation controller is configured to receive the gate voltage of the driving transistor acquired by the signal acquiring circuit and compensate the non-compensation pixel circuits in accordance with the gate voltage of the driving transistor.

For example, in the display panel of an embodiment of the present disclosure, the compensation controller is further configured to: receive a light-emitting data signal received by the compensation driving circuit, subtract a light-emitting voltage in the light-emitting data signal received by the compensation driving circuit from the gate voltage of the driving transistor to get a threshold voltage of the driving transistor, receive light-emitting data signals for the non-compensation pixel circuits, add the threshold voltage to light-emitting voltages of the light-emitting data signals for the non-compensation pixel circuits to get light-emitting voltages of updated light-emitting data signals for the non-compensation pixel circuits, and send the light-emitting voltages of the updated light-emitting data signals to the non-compensation pixel circuits.

For example, in the display panel of an embodiment of the present disclosure, each of the compensation regions includes one compensation pixel circuit and eight non-compensation pixel circuits disposed around the one compensation pixel circuit.

An embodiment of the present disclosure provides a display device, comprising the display panel of any one embodiment of the present disclosure.

An embodiment of the present disclosure provides a regional compensation method, comprising: receiving a gate voltage of a driving transistor acquired by a signal acquiring circuit in a compensation pixel circuit; and compensating non-compensation pixel circuits in accordance with the gate voltage of the driving transistor.

For example, in the regional compensation method of an embodiment of the present disclosure, compensating the non-compensation pixel circuits in accordance with the gate voltage of the driving transistor comprises: receiving a light-emitting data signal received by the compensation driving circuit; subtracting a light-emitting voltage in the light-emitting data signal received by the compensation driving circuit from the gate voltage of the driving transistor to get a threshold voltage of the driving transistor, receiving light-emitting data signals for the non-compensation pixel circuits; adding the threshold voltage to light-emitting voltages of the light-emitting data signals for the non-compensation pixel circuits to get light-emitting voltages of updated light-emitting data signals for the non-compensation pixel circuits, and sending the light-emitting voltages of the updated light-emitting data signals to the non-compensation pixel circuits.

An embodiment of the present disclosure provides a method for driving the compensation pixel circuit of any one embodiment of the present disclosure, comprises: a reset period, a compensation period and a light-emitting period, wherein in the reset period, the control signal is set to be a turn-on voltage, the first scanning signal is set to be a turn-off voltage, and the second scanning signal is set to be a turn-off voltage; in the compensation period, the control signal is set to be a turn-off voltage, the first scanning signal is set to be a turn-on voltage, and the second scanning signal is set to be a turn-off voltage; and in the light-emitting period, the control signal is set to be a turn-off voltage, the first scanning signal is set to be a turn-off voltage, and the second scanning signal is set to be a turn-on voltage.

For example, the driving method of an embodiment of the present disclosure further comprises, before the reset period, a preparation period, in which the control signal is set to be a turn-off voltage, the first scanning signal is set to be a turn-off voltage and the second scanning signal is set to be a turn-off voltage.

BRIEF DESCRIPTION OF DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

FIG. 1(*b*) is a schematic diagram of another compensation pixel circuit provided in an embodiment of the present disclosure;

FIG. 2(*b*) is a schematic diagram of a signal acquiring circuit in a compensation pixel circuit provided in an embodiment of the present disclosure;

DETAILED DESCRIPTION

Figure 1A:
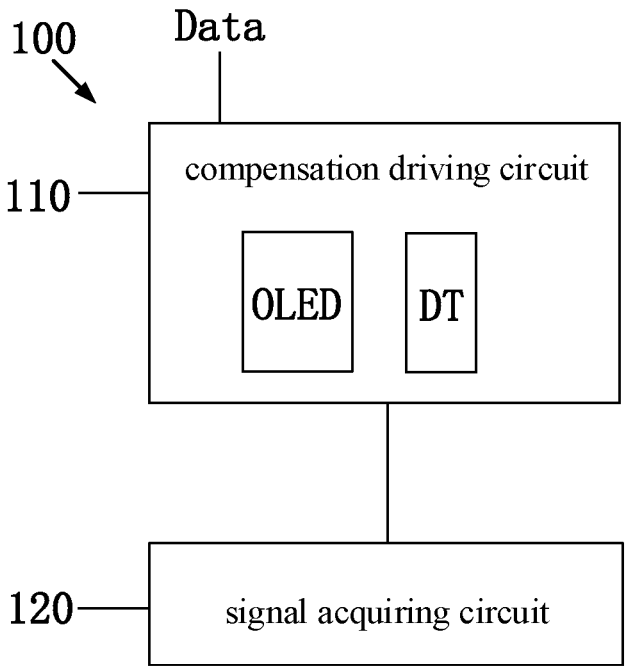
FIG. 1(*a*) is a schematic diagram of a compensation pixel circuit provided in an embodiment of the present disclosure.

In the following, technical solutions of the embodiments of the present disclosure will be described in a clearly and fully understandable way in connection with the drawings; with reference to the non-limiting exemplary embodiments, which are illustrated in the drawings and detailed described in the following, the exemplary embodiments and the features and favorable details of the present disclosure will be described more comprehensively. It should be noted that the features in the drawings are not necessarily illustrated in proportion. The present disclosure omits the descriptions of known materials, components, and processing technologies to avoid the vagueness occurring to the exemplary embodiments of the present disclosure. The examples are intended for helping understand the implementation methods of the embodiments of the present disclosure, such that those skilled in the art can implement the exemplary embodiments. Therefore, those examples are not limitative of the scope of the embodiment of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. In addition, in the embodiments of the present disclosure, identical or similar numerals represent identical or similar components.

In recent years, with the rise of consumer electronics for augmented reality, virtual reality or the like, there is an increasingly urgent demand for display panels of high resolutions to improve the users' watching experiences.

The resolution of an OLED display panel is mainly subject to the level of the photolithographic process and the size of the fine metal mask (FFM). When the photolithographic process and the fabrication of the fine metal mask have reached a certain level, it is difficult for the resolution of an OLED display panel to be further improved. Therefore, another way needs to be found to handle the problem about a high resolution.

Figure 6:
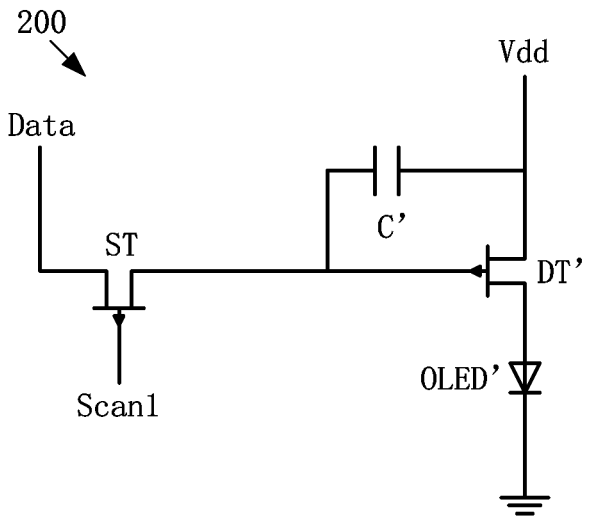
FIG. 6 is a schematic diagram of a non-compensation pixel circuit provided in an embodiment of the present disclosure.

An OLED display panel typically uses active driving manner, incorporating a plurality of sub-pixels arranged in an array. The most basic pixel circuit of each sub-pixel is of a 2T1C mode that includes two transistors (a scanning transistor and a driving transistor) and a storage capacitor; for example, see the 2T1C pixel circuit as shown in FIG. 6. In order to improve the display uniformity of a whole panel, each sub-pixel may be configured with a pixel circuit having compensation functionality, which may be referred to as a compensation pixel circuit and obtained based on the above-mentioned 2T1C mode. The compensation pixel circuit may be of a voltage compensation type, a current compensation type or a hybrid compensation type, depending on its compensation mechanism. However, although an OLED display panel using compensation pixel circuits may achieve better brightness uniformity in contrast to using the basic 2T1C pixel circuits, the portion of the driving circuit of each sub-pixel occupies more area on the panel, preventing the OLED display panel from obtaining a high resolution.

Embodiments of the present disclosure provide a compensation pixel circuit, a display panel, a display apparatus, a regional compensation method and a driving method, which can achieve threshold voltage compensation by collecting the gate voltage of the driving transistor in a compensation pixel circuit and compensating the surrounding non-compensation pixel circuits based on the voltage. This arrangement reduces the number of compensation driving circuits and the area on the panel occupied by the driving circuits, facilitating improvement of the resolution of the display panel.

Figure 1B:
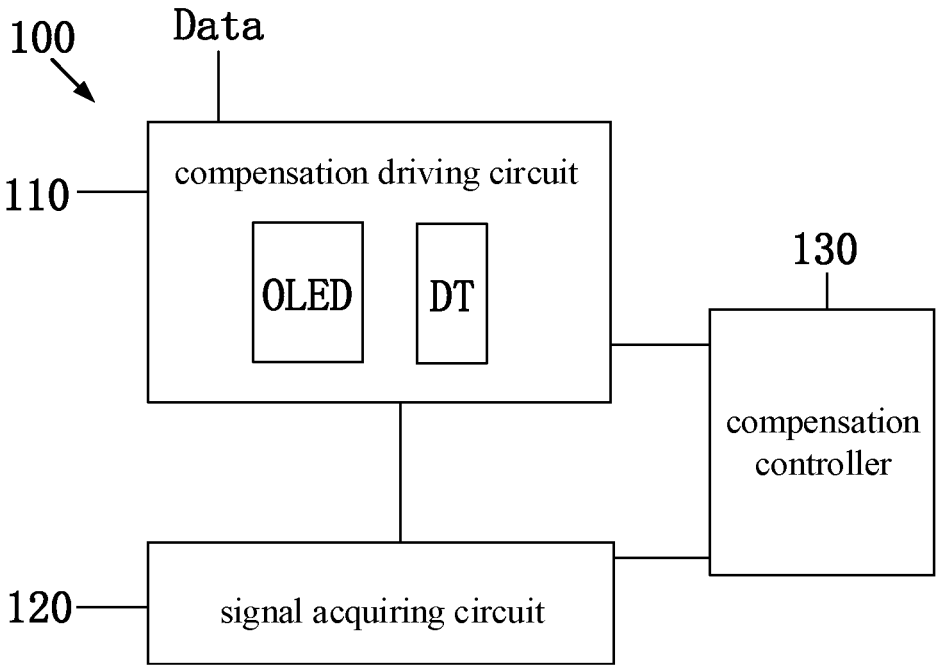

For example, FIG. 1(*a*) is a schematic diagram of a compensation pixel circuit provided in an embodiment of the present disclosure. An embodiment of the present disclosure provides a compensation pixel circuit 100, which, as shown in FIG. 1(*a*), includes a compensation driving circuit 110 and a signal acquiring circuit 120 connected with the compensation driving circuit 110. The compensation driving circuit 110 includes a driving transistor DT and an organic light-emitting diode OLED. The compensation driving circuit 110 is configured to receive a light-emitting data signal Data, compensate the threshold voltage of the driving transistor DT and drive the organic light-emitting diode OLED to illuminate based on the light-emitting data signal Data. The signal acquiring circuit 120 is configured to acquire the voltage at the gate of the driving transistor DT.

For example, FIG. 1(*b*) is a schematic diagram of another compensation pixel circuit provided in an embodiment of the present disclosure. The compensation pixel circuit 100 may further include a compensation controller 130 that is configured to receive the gate voltage of the driving transistor DT acquired by the signal acquiring circuit 120 in the compensation pixel circuit 100 and compensate non-compensation pixel circuits based on the gate voltage of the driving transistor DT. See below for the description about the non-compensation pixel circuits.

For example, in a display panel 10 provided in an embodiment of the present disclosure, the compensation controller 130 is further configured to receive the light-emitting data signal Data received by the driving circuit 110, subtract the light-emitting voltage Vdata in the light-emitting data signal Data received by the driving circuit 110 from the gate voltage of the driving transistor DT (Vdata+Vth) to obtain the threshold voltage Vth of the driving transistor DT, receive a light-emitting data signal Data1 for a non-compensation pixel circuit, add the obtained threshold voltage Vth to the light-emitting voltage Vdata1 in the light-emitting data signal Data1 to get an updated light-emitting data signal with a light-emitting voltage Vdata1+Vth for the non-compensation pixel circuit, and send the light-emitting voltage Vdata1+Vth of the updated light-emitting data signal to the non-compensation pixel circuit. In this way, it is realized that the threshold voltage of the driving transistor in a compensation pixel circuit is acquired and used to compensate threshold voltages of the driving transistors in surrounding non-compensation pixel circuits.

Figure 2A:
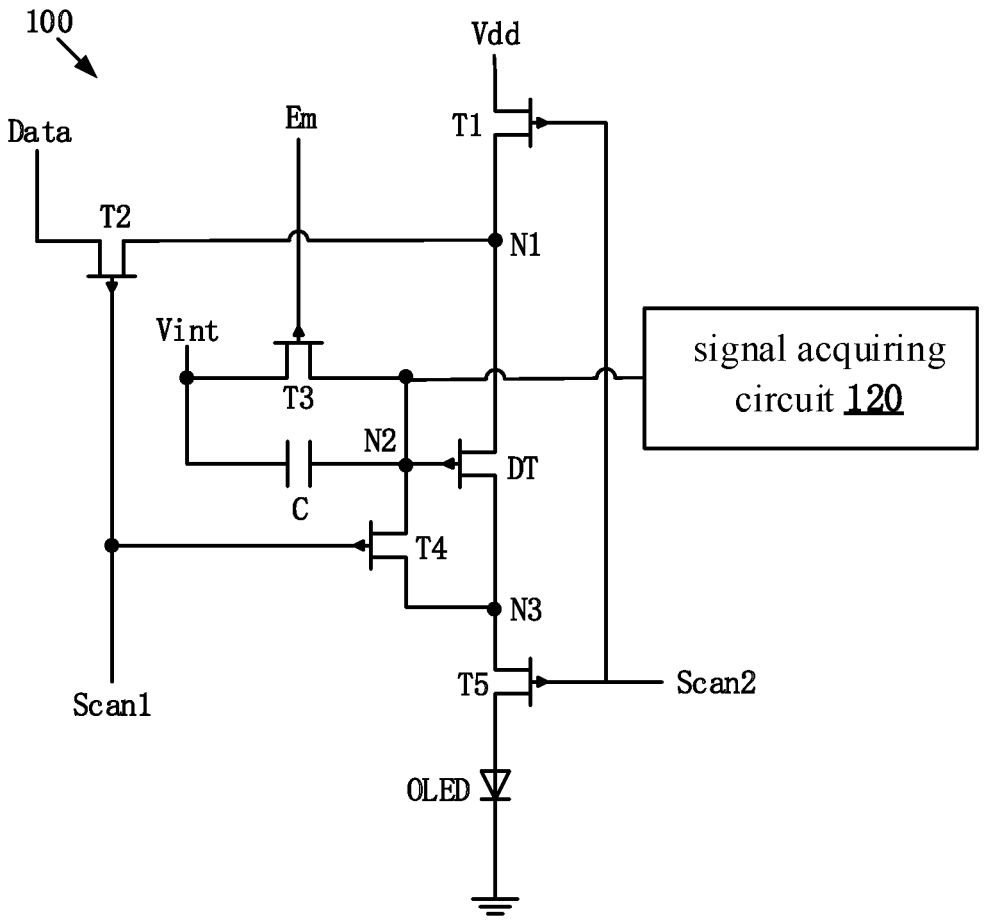
FIG. 2(*a*) is a schematic diagram of yet another compensation pixel circuit provided in an embodiment of the present disclosure.
Figure 2B:
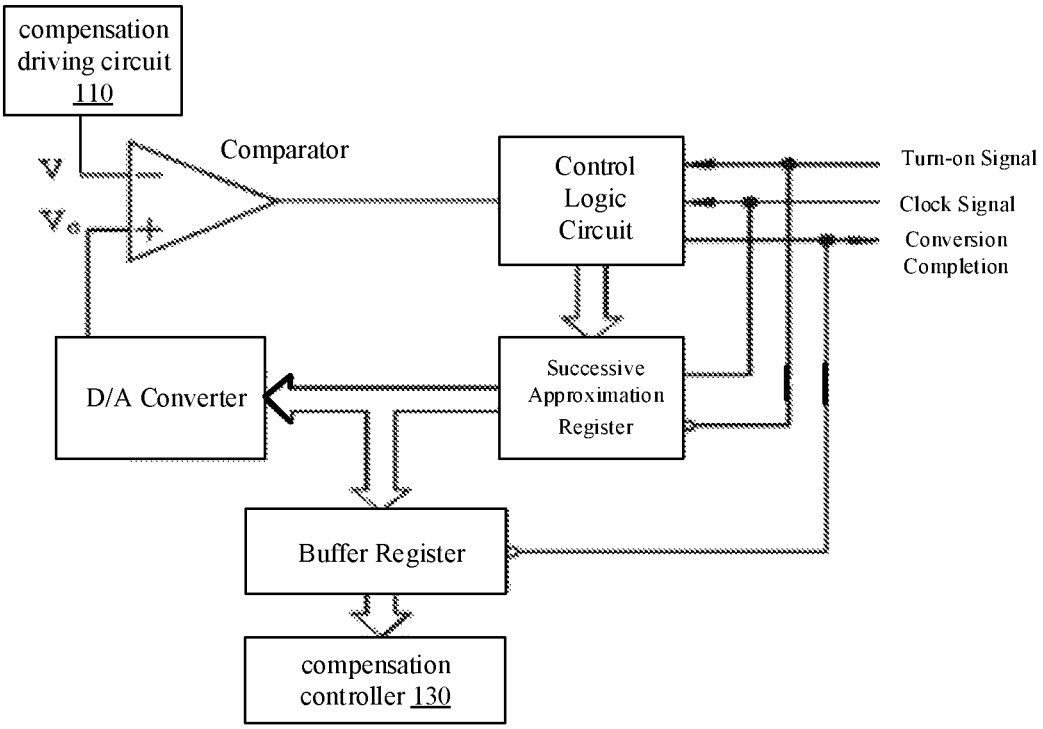

For example, FIG. 2(*a*) is a schematic diagram of another compensation pixel circuit provided in an embodiment of the present disclosure. As shown in FIG. 2(*a*), in the compensation pixel circuit 100 provided in the embodiment of the present disclosure, the signal acquiring circuit 120 is electrically connected with the driving transistor DT to acquire the gate voltage of the driving transistor DT.

For example, as shown in FIG. 2(*a*), the compensation pixel circuit 100 provided in the embodiment of the present disclosure further includes a first transistor T1, a second transistor T2, a third transistor T3, a fourth transistor T4, a fifth transistor T5, and a storage capacitor C.

For example, as shown in FIG. 2(*a*), in the compensation pixel circuit 100 provided in the embodiment of the present disclosure, the first electrode of the first transistor T1 is connected to a first power line to receive a first voltage Vdd, the gate of the first transistor T1 and the gate of the fifth transistor T5 are connected to a second scanning signal line to receive a second scanning signal Scan2, and the second electrode of the first transistor T1 is connected to a first node N1. The first electrode of the second transistor T2 is connected to a light-emitting data signal line to receive a light-emitting data signal Data, the gate of the second transistor T2 and the gate of the fourth transistor T4 are electrically connected to a first scanning signal line to receive a first scanning signal Scan1, and the second electrode of the second transistor is electrically connected to the first node N1. The first electrode of the third transistor T3 is electrically connected to a second power line to receive a second voltage Vint, the gate of the third transistor T3 is electrically connected to a control signal line to receive a control signal Em, and the second electrode of the third transistor T3 is electrically connected to a second node N2. The first electrode of the fourth transistor T4 is electrically connected to the second node N2 and the second electrode of the fourth transistor T4 is electrically connected to a third node N3. The first electrode of the fifth transistor T5 is electrically connected to the third node N3 and the second electrode of the fifth transistor T5 is electrically connected to the first electrode (e.g., an anode) of an organic light-emitting diode OLED. The second electrode (e.g., a cathode) of the organic light-emitting diode OLED is connected to ground. The first electrode of the driving transistor DT is electrically connected to the first node N1, the gate of the driving transistor DT is electrically connected to the second node N2, and the second electrode of the driving transistor DT is electrically connected to the third node N3. The first terminal of a storage capacitor C is electrically connected to the second power line and the second terminal of the storage capacitor C is electrically connected to the second node N2.

For example, the compensation driving circuit in the pixel circuit 100 as shown in FIG. 2(*a*) has a simple structure, is easy to fabricate, operates stably, and achieves good threshold voltage compensation for the driving transistor.

Figure 10A:
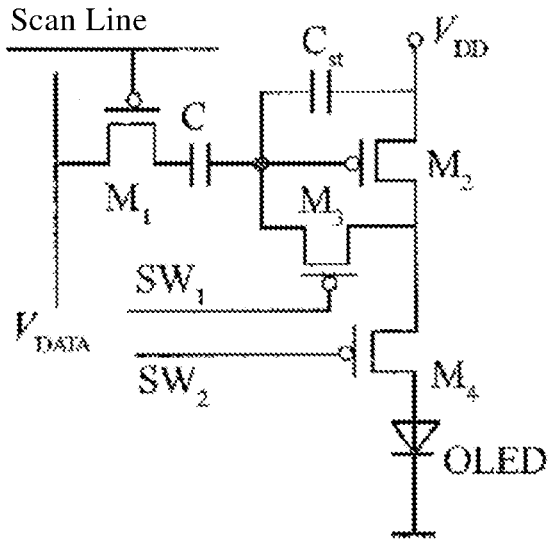
FIGS. 10(*a*) and 10(*b*) show a 4T2C compensation driving circuit and a 4T1C compensation driving circuit respectively.
Figure 10B:
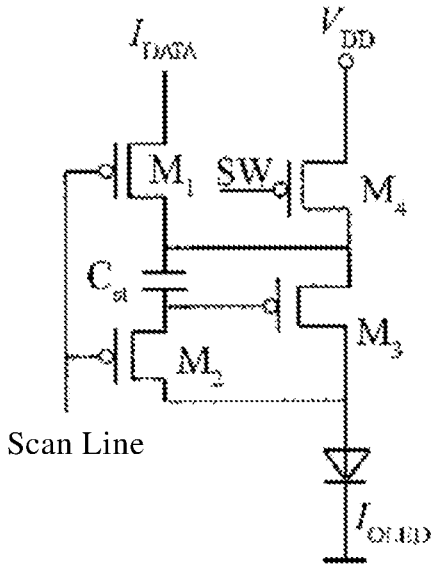

For example, the compensation driving circuit in the compensation pixel circuit 100 as shown in FIG. 2(*a*) is only an example. In an embodiment of the present disclosure, the compensation driving circuit in the pixel circuit 100 may be any other compensation driving circuit that has the function of compensating the threshold voltage of the driving transistor DT and the function of driving the organic light-emitting diode OLED to illuminate based on a light-emitting data signal Data. For example, with reference to FIGS. 10(*a*) and 10(*b*), the compensation driving circuit may also be the circuit shown in FIG. 10(*a*) or FIG. 10(*b*). For example, the 4T2C circuit as shown in FIG. 10(*a*) operates on such a fundamental principle that the driving transistor M2 is firstly turned off and then connected as a diode that is in an ON state to charge the storage capacitor Cst until the driving transistor is turned off after the voltage at its gate reaches the threshold voltage, so that the threshold voltage is stored in the storage capacitor Cst. For example, in the 4T1C circuit as shown in FIG. 10(*b*), the transistor M1 is firstly turned on to charge the storage capacitor Cst so as to turn on the transistor M2 and the transistor M3 is connected as a diode, so that the driving current $I_{DAT4}$ is converted into a voltage stored on the storage capacitor Cst.

For example, in the compensation pixel circuit 100 provided in the embodiment of the present disclosure, the second power line is connected to ground. That is to say, the second voltage Vint is the ground voltage (e.g., 0 V).

It is to be noted that embodiments of the present disclosure are not limited to the case that the second voltage is the ground voltage and the second voltage may be a low stable voltage instead, for example, 1V.

For example, in the compensation pixel circuit 100 provided in the embodiment of the present disclosure, the first transistor T1, the second transistor T2, the third transistor T3, the fourth transistor T4 and the fifth transistor T5 are all p-type transistors. For example, using the same type of transistors can render the fabrication processes to be consistent and provide convenience for product manufacture.

For example, in the compensation pixel circuit 100 provided in the embodiment of the present disclosure, the first transistor T1, the second transistor T2, the third transistor T3, the fourth transistor T4 and the fifth transistor T5 are all thin film transistors.

It is to be noted that, in an embodiment of the present disclosure, the transistors may be thin film transistors, field effect transistors or other switching devices of the same property. As used herein, the source and the drain of a transistor may be symmetrical and thus have no difference in structure. In embodiments of the present disclosure, in order to distinguish between the two electrodes of a transistor other than the gate, one of them is described directly as a first electrode and the other as a second electrode; therefore the first electrodes and the second electrodes may be interchangeable as needed for some or all transistors in embodiments of the present disclosure. For example, in embodiments of the present disclosure, the first electrode of a transistor may be the source of the transistor while the second electrode may be the drain; or the first electrode of a transistor is the drain while the second electrode is the source. Furthermore, transistors may be classified into N-type transistors and P-type transistors in terms of their properties and embodiments of the present disclosure are described in the case that the first, second, third, fourth and fifth transistors are all p-type transistors. Based on the description and teaching about the implementations of the present disclosure, it will readily occur to those of ordinary skills in the art without any creative effort that embodiments of the present disclosure can be implemented using N-type transistors or combinations of N-type transistors and P-type transistors. Therefore, those implementations also fall into the scope claimed by the present disclosure.

For example, the first, second, third, fourth and fifth transistors are all p-type transistors, so that the compensation driving circuit may be implemented conveniently, easy to fabricate and have simple signal setting.

For example, in an embodiment of the present disclosure, the signal acquiring circuit may be implemented using an analog to digital (A/D) converter, which acts to convert an analog quantity continuous in time and amplitude into a digital signal discrete in time and amplitude.

For example, the signal acquiring circuit may be disposed on a display panel by means of an integrated circuit chip.

For example, FIG. 2(*b*) is a schematic diagram of a signal acquiring circuit in a compensation pixel circuit provided in an embodiment of the present disclosure. The signal acquiring circuit shown in FIG. 2(*b*) is implemented using a successive approximation analog to digital converter.

It is to be noted that, in an embodiment of the present disclosure, the signal acquiring circuit in the compensation pixel circuit is not limited to that as shown in FIG. 2(*b*) and may also be implemented using any other circuit with the function of voltage acquiring.

For example, as shown in FIG. 2(*b*), the function of signal acquiring may be achieved just by connecting the compensation driving circuit 110 to the "–" terminal of the comparator in the signal acquiring circuit and connecting the compensation controller 130 to the buffer register in the signal acquiring circuit.

For example, in embodiments of the present disclosure, a turn-on voltage refers to a voltage that can make the first and second electrodes of a transistor form an electrically conductive path therebetween, while a turn-off voltage refers to a voltage that can make the first electrode of a transistor electrically disconnected from the second electrode of the transistor. When a transistor is a P-type transistor, the turn-on voltage is a low voltage (e.g., 0V) and the turn-off voltage is a high voltage (e.g., 5V); when a transistor is an N-type transistor, the turn-on voltage is a high voltage (e.g., 5V) and the turn-off voltage is a low voltage (e.g., 0V). The driving waveform as shown in FIG. 3 is illustrated with P-type transistors as an example, meaning that the turn-on voltage is a low voltage (e.g., 0V) and the turn-off voltage is a high voltage (e.g., 5V).

Figure 3:
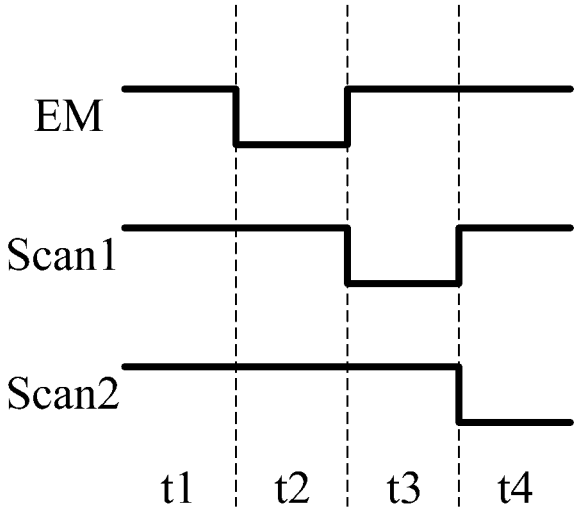
FIG. 3 is a schematic timing diagram for driving a compensation pixel circuit provided in an embodiment of the present disclosure as shown in FIG. 2(*a*)

For example, FIG. 3 is a schematic timing diagram for driving a compensation pixel circuit provided in an embodiment of the present disclosure as shown in FIG. 2(*a*). An embodiment of the present disclosure further provides a method for driving the compensation pixel circuit provided in any embodiment of the present disclosure. The driving method and the operating process of the compensation pixel circuit will be described in the following in combination with FIGS. 2(*a*) and 3.

During a preparation period t1, the control signal Em is a turn-off voltage, the first scanning signal Scan1 is a turn-off voltage, and the second scanning signal Scan2 is a turn-off voltage. Therefore, the first transistor T1, the second transistor T2, the third transistor T3, the fourth transistor T4 and the fifth transistor T5 are all in an off state. The preparation period provides a process for the compensation pixel circuit to stabilize, preventing circuit abnormality due to incomplete discharge of parasitic capacitance or the like.

During a reset period t2, the control signal Em is a turn-on voltage, the first scanning signal Scan 1 is a turn-off voltage and the second scanning signal Scan2 is a turn-off voltage. Therefore, the third transistor T3 is turned on, and the first transistor T1, the second transistor T2, the fourth transistor T4 and the fifth transistor T5 are all turned off. The voltage across the storage capacitor is initialized to be the second voltage Vint (e.g., a low stable voltage or a ground voltage), completing initialization of the compensation pixel circuit.

During a compensation period t3, the control signal Em is a turn-off voltage, the first scanning signal Scan1 is a turn-on voltage and the second scanning signal Scan2 is a turn-off voltage. Therefore, the second transistor T2 and the fourth transistor T4 are turned on, and the first transistor T1, the third transistor T3 and the fifth transistor T5 are all turned off. The second node N2 is charged by a light-emitting data signal Data through the second transistor T2, the driving transistor DT and the fourth transistor T4 until the voltage at the second node N2 reaches Vdata+Vth, where Vdata is the light-emitting voltage of the light-emitting data signal Data and Vth is the threshold voltage of the driving transistor DT, because at this point it is satisfied that the difference between the voltages at the gate and source of the driving transistor DT is Vth. Upon completion of charging, the voltage across the storage capacitor C is Vdata+Vth. In addition, since the fifth transistor T5 is in an OFF state, no current flows through the OLED and the OLED is prevented from illuminating, which improves display effect and reducing aging of the OLED. For example, after completion of charging and before a light-emitting period t4, the signal acquiring circuit 120 acquires the voltage at the gate of the driving transistor DT (Vdata+Vth) and uses the voltage to compensate non-compensation pixel circuits around the compensation pixel circuit.

During the light-emitting period t4, the control signal Em is a turn-off voltage, the first scanning signal Scan1 is a turn-off voltage and the second scanning signal Scan2 is a turn-on voltage. Therefore, the first transistor T1 and the fifth transistor T5 are turned on, and the second transistor T2, the third transistor T3 and the fourth transistor T4 are all in turned off. During the light-emitting period, owing to the function of the storage capacitor C, the voltage at the third node N3 is kept at Vdata+Vth, and the light emitting current IDLED flows through the first transistor T1, the driving transistor DT, the fifth transistor T5 and the organic light-emitting diode OLED, making the organic light-emitting diode OLED illuminate. The light-emitting current IDLED satisfies the following saturation current equation:

$$\begin{aligned} IOLED &= K(VGS - Vth)^2 \\ &= K(Vdata + Vth - Vdd - Vth)^2 \\ &= K(Vdata - Vdd)^2 \end{aligned}$$

where $K=0.5\mu_n Cox\ W/L$, $\mu_n$ is the channel mobility of the driving transistor, Cox is the channel capacitance per unit area of the driving transistor, W and L are the width and length of the driving transistor respectively, and VGS is the gate-source voltage (the difference between the voltages at the gate and source of the driving transistor).

It can be seen that the light emitting current IDLED is no longer influenced by the threshold voltage Vth of the driving transistor and related only to the voltage of the light emitting data signal Vdata and the first voltage Vdd. As a result, the problem of threshold voltage drift of the driving transistor is solved and the OLED display panel is guaranteed to operate properly.

It is to be noted that, the driving method provided in the embodiment of the present disclosure can include only the reset period t2, the compensation period t3 and the light-emitting period t4, without the preparation period t1. No limitation about this is intended to be set herein.

Figure 4:
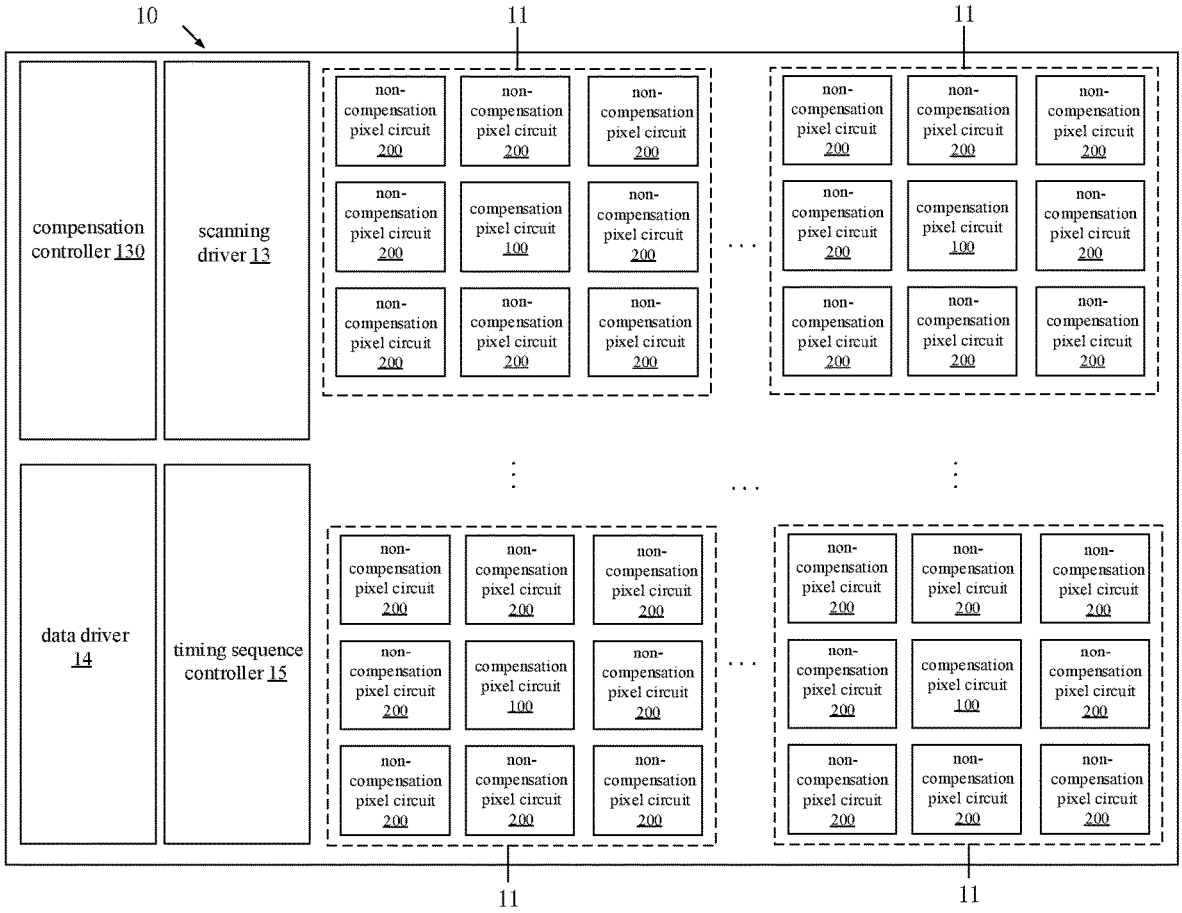
FIG. 4 is a schematic diagram of a display panel provided in an embodiment of the present disclosure.

For example, FIG. 4 is a schematic diagram of a display panel provided in an embodiment of the present disclosure. An embodiment of the present disclosure further provides a display panel 10, which, as shown in FIG. 4, includes the compensation pixel circuit 100 provided in any embodiment of the present disclosure.

For example, the display panel 10 provided in the embodiment of the present disclosure includes a plurality of compensation regions 11, each compensation region 11 including at least one compensation pixel circuit 100.

For example, as shown in FIG. 4, in the display panel 10 provided in the embodiment of the present disclosure, each compensation region 11 further includes non-compensation pixel circuits 200, and the sub-pixel areas occupied by the non-compensation pixel circuits 200 are adjacent to the sub-pixel area occupied by the compensation pixel circuit 100.

For example, as shown in FIG. 4, the compensation controller 130 may also be disposed in the display panel 10 and configured to receive the gate voltage of the driving transistor DT acquired by the signal acquiring circuit 120 in the compensation pixel circuit 100 and compensate non-compensation pixel circuits 200 (e.g., those in the same compensation region) based on the gate voltage of the driving transistor DT.

For example, as shown in FIG. 4, the display panel 10 provided in the embodiment of the present disclosure further includes a scanning driver 13, a data driver 14, a timing sequence controller 15, light-emitting data signal lines, first scanning signal lines, second scanning signal lines and control signal lines (the light-emitting data signal lines, the first scanning signal lines, the second scanning signal lines, and the control lines are not shown in FIG. 4). The data driver 14 is configured to provide light-emitting data signals to the compensation pixel circuit 100 and the non-compensation pixel circuits 200 through the light-emitting data signal line; the scanning driver 13 is configured to provide the first scanning signal Scan1, the second scanning signal Scan2 and the control signal Em to the first scanning signal lines, the second scanning signal lines, and the control signal lines respectively; the timing sequence controller 15 is configured to provide a clock signal to coordinate the system's operations.

For example, in the display panel 10 provided in the embodiment of the present disclosure, the compensate controller 130 is further configured to receive the light-emitting data signal Data received by the driving circuit 110, subtract the light-emitting voltage Vdata in the light-emitting data signal Data received by the driving circuit 110 from the gate voltage of the driving transistor DT (Vdata+Vth) to obtain the threshold voltage Vth of the driving transistor DT, receive a light-emitting data signal Data1 for a non-compensation pixel circuit, add the obtained threshold voltage Vth to the light-emitting voltage Vdata1 in the light-emitting data signal Data1 to get an updated light-emitting data signal with a light-emitting voltage Vdata1+Vth for the non-compensation pixel circuit, and send the light-emitting voltage Vdata1+Vth of the updated light-emitting data signal to the non-compensation pixel circuit. In this way, it is realized that the threshold voltage of the driving transistor in a compensation pixel circuit is acquired and used to compensate the threshold voltages of the driving transistors in the surrounding non-compensation pixel circuits.

It is to be noted that because process characteristics of regions located in a neighborhood in the display panel are relatively approximate to each other, threshold voltages and drift characteristics of driving transistors in those regions are also approximate to each other. Therefore, the threshold voltage of the driving transistor in a compensation pixel circuit may be acquired and used to compensate threshold voltages of the driving transistors in the surrounding non-compensation pixel circuits. For example, the compensation controller superimposes the threshold voltage onto the light-emitting data signals for non-compensation circuits to achieve threshold voltage compensation. At the same time, the design of using the compensation pixel circuit in coordination with non-compensation pixel circuits can reduce the area occupied by the portion of the driving circuit in the pixel circuit and in turn improve the resolution of the display panel.

For example, as shown in FIG. 4, in the display panel 10 in an embodiment of the present disclosure, each compensation region 11 includes one compensation pixel circuit 100 and eight non-compensation pixel circuits 200 surrounding the compensation pixel circuit 100.

It is to be noted that the compensation region 11 is not limited to the arrangement in the manner as shown in FIG. 4 and may be arranged in any other way.

Figure 5:
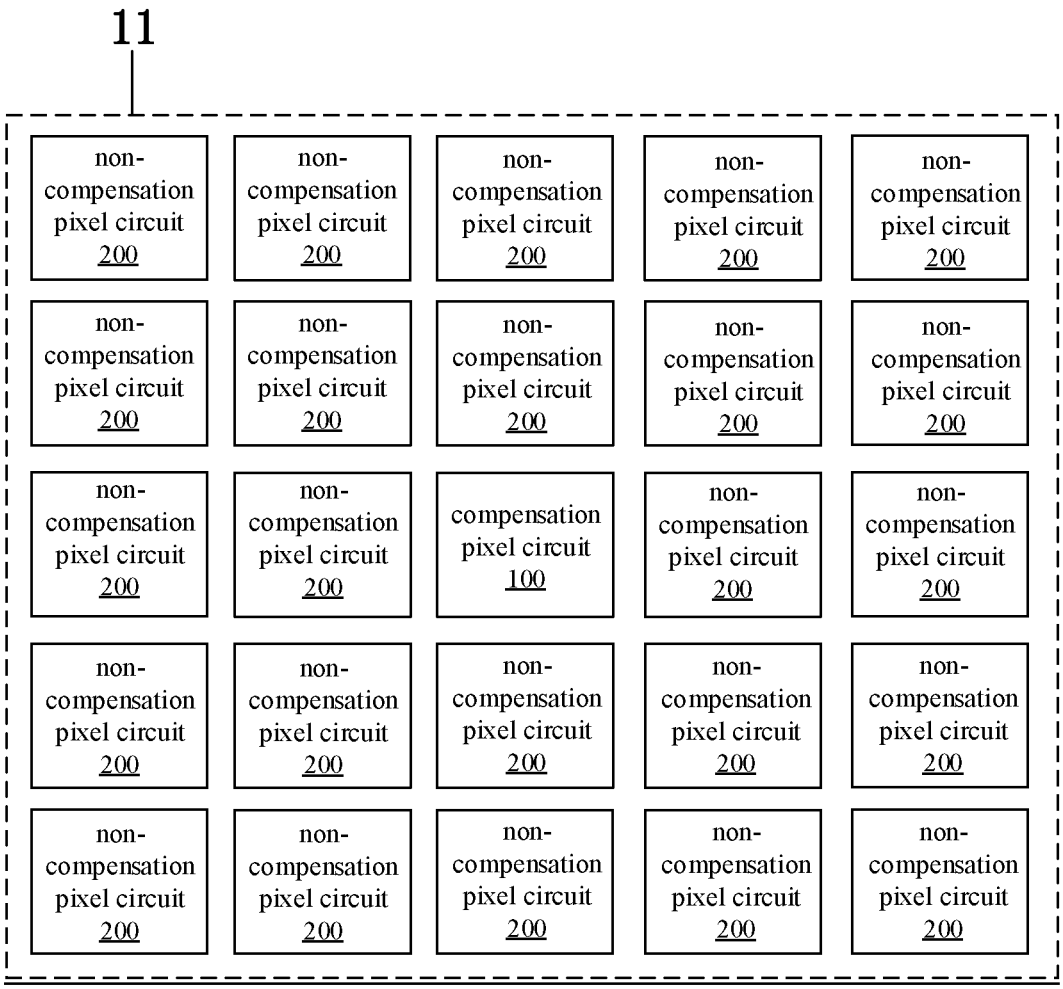
FIG. 5 is a schematic diagram illustrating an example of compensation regions in a display panel provided in an embodiment of the present disclosure.

For example, FIG. 5 is a schematic diagram of an example of a compensation region in a display panel provided in an embodiment of the present disclosure. As shown in FIG. 5, the compensation region 11 includes one compensation pixel circuit 100 and twenty four non-compensation pixel circuits 200. That is to say, the threshold voltage acquired from one compensation pixel circuit may be used to compensate the surrounding twenty four non-compensation pixel circuits.

For example, the way in which the compensation region 11 is arranged may be chosen based on comprehensive considerations regarding consistency of the threshold voltages of the driving transistors, the landing area to be occupied by the pixel circuit, and other factors. For example, when the consistency of the threshold voltages of the driving transistors is high, the compensating region may be set larger, i.e., the threshold voltage acquired from one compensation pixel circuit may be used to compensate more surrounding non-compensation pixel circuits.

For example, FIG. 6 is a schematic diagram of a non-compensation pixel circuit provided in an embodiment of the present disclosure. The non-compensation pixel circuit 200 is a 2T1C circuit (i.e., including two transistors (a scanning transistor ST and a driving transistor DT) and a storage capacitor C). The non-compensation pixel circuit 200 has no threshold compensation function, but occupies a relatively small area. The non-compensation pixel circuit 200 is used in coordination with the compensation pixel circuit to improve the resolution of the display panel. It is to be noted that the non-compensation pixel circuit as shown in FIG. 7 is only an example and embodiments of the present disclosure can include but not limited to it.

Figure 7:
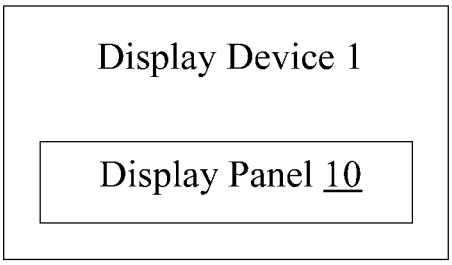
FIG. 7 is a schematic diagram of a display apparatus provided in an embodiment of the present disclosure.

FIG. 7 is a schematic diagram of a display apparatus provided in an embodiment of the present disclosure. An embodiment of the present invention further provides a display apparatus 1, which includes the display panel 10 provided in an embodiment of the present disclosure as shown in FIG. 7.

For example, the display apparatus provided in the embodiment of the present disclosure may include any product or component with display functionality, such as a cellphone, a tablet computer, a TV set, a display, a notebook computer, a digital picture frame, a navigator, etc.

Figure 8:
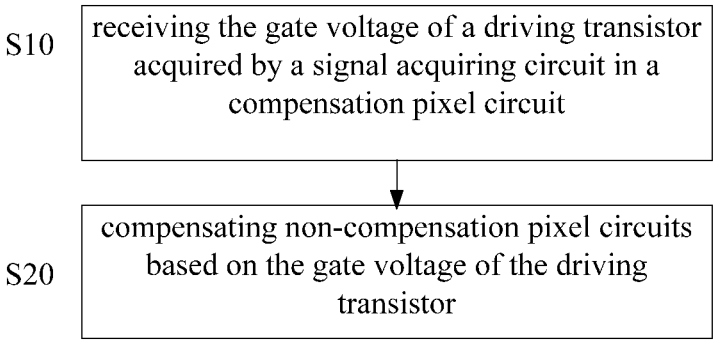
FIG. 8 is a flow chart of a method for regional compensation provided in an embodiment of the present disclosure.

For example, FIG. 8 is a flow chart illustrating a regional compensation method provided in an embodiment of the present disclosure. An embodiment of the present disclosure further provides a regional compensation method, which, as shown in FIG. 8, includes the following operations:

Step S10: receiving the gate voltage of a driving transistor acquired by a signal acquiring circuit in a compensation pixel circuit; and Step S20: compensating non-compensation pixel circuits based on the gate voltage of the driving transistor.

Figure 9:
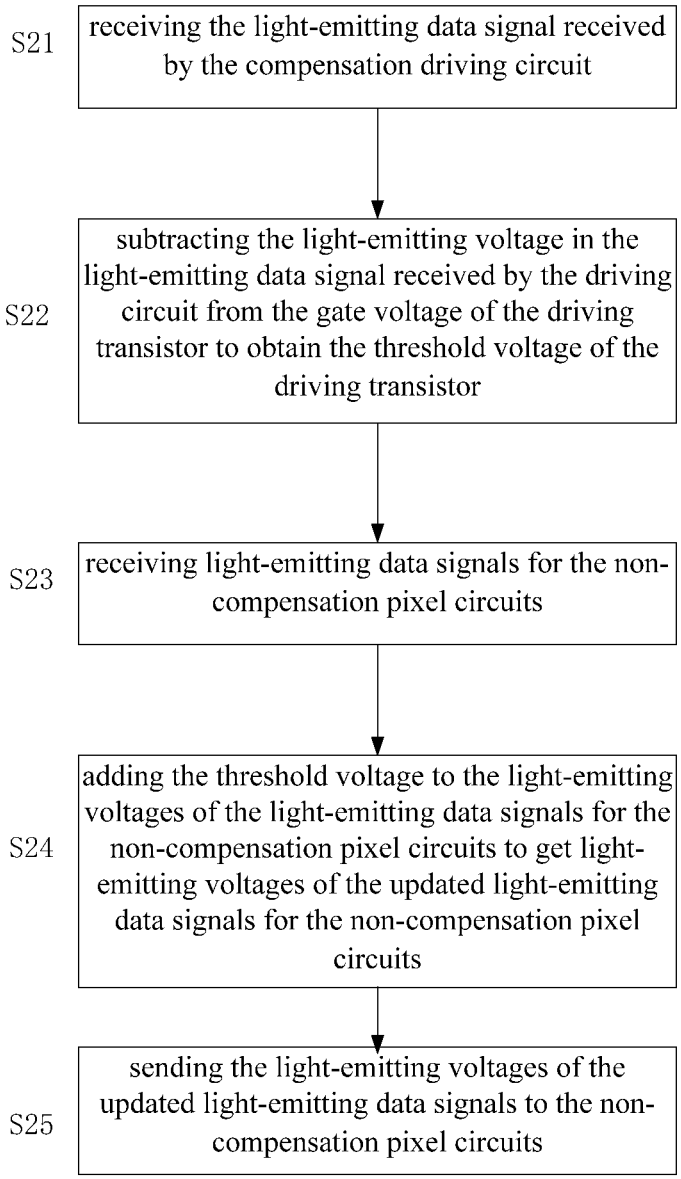
FIG. 9 is a flow chart illustrating an example of step S20 in a regional compensation method provided in an embodiment of the present disclosure as shown in FIG. 8.

For example, FIG. 9 is a flow chart illustrating an example of step S20 of the regional compensation method provided in the embodiment of the present disclosure shown in FIG. 8. As shown in FIG. 9, in the regional compensation method provided in an embodiment of the present disclosure, compensating non-compensation pixel circuits based on the gate voltage of the driving transistor (i.e., the above-mentioned step S20) further includes the following operations:

Step S21: receiving the light-emitting data signal received by the compensation driving circuit;

Step S22: subtracting the light-emitting voltage in the light-emitting data signal received by the driving circuit from the gate voltage of the driving transistor to obtain the threshold voltage of the driving transistor;

Step S23: receiving light-emitting data signals for the non-compensation pixel circuits;

Step S24: adding the threshold voltage to the light-emitting voltages of the light-emitting data signals for the non-compensation pixel circuits to get light-emitting voltages of the updated light-emitting data signals for the non-compensation pixel circuits; and Step S25: sending the light-emitting voltages of the updated light-emitting data signals to the non-compensation pixel circuits.

For example, the sequence of the steps above is only an example for embodiments of the present disclosure and in no way to limit the present disclosure; the sequence of some steps may be changed without affecting implementation of the regional compensation method provided in the embodiments of the present disclosure. For example, step S22 and step S23 may be interchangeable in sequence.

Embodiments of the present disclosure provide a compensation pixel circuit, a display panel, a display apparatus, a regional compensation method and a driving method, which can achieve threshold voltage compensation by collecting the gate voltage of the driving transistor in a compensation pixel circuit and compensating the surrounding non-compensation pixel circuits based on the voltage. This arrangement reduces the number of compensation driving circuits and the area on the panel occupied by the driving circuits, facilitating improvement of the physical resolution of the display panel.

Although the present disclosure is conducted in detail through the general illustrative description and specific embodiments, based on the described embodiments of the present disclosure, modifications or improvements can be performed without any inventive work, which would be obvious for those skilled in the related art. These modifications or improvements made without departing from the spirit of the present disclosure should be within the scope that is claimed for protection in the present disclosure.

The application claims priority to the Chinese patent application No. 201610664473.0, filed Aug. 12, 2016, the entire disclosure of which is incorporated herein by reference as part of the present application.

What is claimed is:

1. A compensation pixel circuit, comprising:

a compensation driving circuit, comprising a driving transistor and an organic light-emitting diode, wherein the compensation driving circuit is configured to receive a light-emitting data signal, compensate a threshold voltage of the driving transistor, and drive the organic light-emitting diode to illuminate in accordance with the light-emitting data signal;

a signal acquiring circuit connected with the compensation driving circuit and configured to acquire a gate voltage of the driving transistor and be capable of converting the gate voltage into a digital signal; and a compensation controller, configured to receive the gate voltage of the driving transistor acquired by the signal acquiring circuit, the compensation controller is further configured to:

receive the light-emitting data signal received by the compensation driving circuit, subtract a light-emitting voltage in the light-emitting data signal received by the compensation driving circuit from the gate voltage of the driving transistor to obtain the threshold voltage of the driving transistor.

2. The compensation pixel circuit of claim 1, wherein the signal acquiring circuit is electrically connected to the driving transistor.

3. The compensation pixel circuit of claim 1, wherein the compensation driving circuit further comprises a first transistor, a second transistor, a third transistor, a fourth transistor, a fifth transistor, and a storage capacitor.

4. The compensation pixel circuit of claim 3, wherein a first electrode of the first transistor is electrically connected to a first power line to receive a first voltage, a gate of the first transistor and a gate of the fifth transistor are electrically connected to a second scanning signal line to receive a second scanning signal, and a second electrode of the first transistor is electrically connected to a first node;

a first electrode of the second transistor is electrically connected to a light-emitting data signal line to receive the light-emitting data signal, a gate of the second transistor and a gate of the fourth transistor are electrically connected to a first scanning signal line to receive a first scanning signal, and a second electrode of the second transistor is electrically connected to the first node;

a first electrode of the third transistor is electrically connected to a second power line to receive a second voltage, a gate of the third transistor is electrically connected to a control signal line to receive a control signal, and a second electrode of the third transistor is electrically connected to a second node;

a first electrode of the fourth transistor is electrically connected to the second node, and a second electrode of the fourth transistor is electrically connected to a third node;

a first electrode of the fifth transistor is electrically connected to the third node and a second electrode of the fifth transistor is electrically connected to a first electrode of the organic light-emitting diode;

a second electrode of the organic light-emitting diode is connected to ground;

a first electrode of the driving transistor is electrically connected to the first node, a gate of the driving transistor is electrically connected to the second node, and a second electrode of the driving transistor is electrically connected to the third node; and a first terminal of the storage capacitor is electrically connected to the second power line and a second terminal of the storage capacitor is electrically connected to the second node.

5. The compensation pixel circuit of claim 4, wherein the second power line is connected to ground.

6. A method for driving the compensation pixel circuit of claim 4, comprising: a reset period, a compensation period and a light-emitting period, wherein in the reset period, the control signal is set to be a turn-on voltage, the first scanning signal is set to be a turn-off voltage, and the second scanning signal is set to be a turn-off voltage;

in the compensation period, the control signal is set to be a turn-off voltage, the first scanning signal is set to be a turn-on voltage, and the second scanning signal is set to be a turn-off voltage; and in the light-emitting period, the control signal is set to be a turn-off voltage, the first scanning signal is set to be a turn-off voltage, and the second scanning signal is set to be a turn-on voltage.

7. The method of claim 6, further comprising, before the reset period, a preparation period, in which the control signal is set to be a turn-off voltage, the first scanning signal is set to be a turn-off voltage and the second scanning signal is set to be a turn-off voltage.

8. The compensation pixel circuit of claim 3, wherein the first transistor, the second transistor, the third transistor, the fourth transistor and the fifth transistor are all p-type transistors.

9. The compensation pixel circuit of claim 3, wherein the first transistor, the second transistor, the third transistor, the fourth transistor and the fifth transistor are all thin film transistors.

10. A display panel, comprising the compensation pixel circuit of claim 1.

11. The display panel of claim 10, further comprising a plurality of compensation regions, wherein each of the plurality of compensation regions comprises at least one of the compensation pixel circuit and non-compensation pixel circuits, and sub-pixel areas occupied by the non-compensation pixel circuits are adjacent to a sub-pixel area occupied by the compensation pixel circuit.

12. The display panel of claim 11, further comprising a compensation controller, wherein the compensation controller is configured to receive the gate voltage of the driving transistor acquired by the signal acquiring circuit and compensate the non-compensation pixel circuits in accordance with the gate voltage of the driving transistor.

13. The display panel of claim 12, wherein the compensation controller is further configured to:

receive a light-emitting data signal received by the compensation driving circuit, subtract a light-emitting voltage in the light-emitting data signal received by the compensation driving circuit from the gate voltage of the driving transistor to get a threshold voltage of the driving transistor, receive light-emitting data signals for the non-compensation pixel circuits, add the threshold voltage to light-emitting voltages of the light-emitting data signals for the non-compensation pixel circuits to get light-emitting voltages of updated light-emitting data signals for the non-compensation pixel circuits, and send the light-emitting voltages of the updated light-emitting data signals to the non-compensation pixel circuits.

14. The display panel of claim 11, wherein each of the compensation regions includes one compensation pixel circuit and eight non-compensation pixel circuits disposed around the one compensation pixel circuit.

15. A display device, comprising the display panel of claim 10.

16. A regional compensation method, comprising:

receiving a gate voltage of a driving transistor acquired by a signal acquiring circuit in a compensation pixel circuit; and compensating non-compensation pixel circuits in accordance with the gate voltage of the driving transistor, wherein compensating the non-compensation pixel circuits in accordance with the gate voltage of the driving transistor comprises:

receiving a light-emitting data signal received by the compensation driving circuit;

subtracting a light-emitting voltage in the light-emitting data signal received by the compensation driving circuit from the gate voltage of the driving transistor to get a threshold voltage of the driving transistor, receiving light-emitting data signals for the non-compensation pixel circuits;

adding the threshold voltage to light-emitting voltages of the light-emitting data signals for the non-compensation pixel circuits to get light-emitting voltages of updated light-emitting data signals for the non-compensation pixel circuits, and sending the light-emitting voltages of the updated light-emitting data signals to the non-compensation pixel circuits.

17. A compensation pixel circuit, comprising:

a compensation driving circuit, comprising a driving transistor and an organic light-emitting diode, wherein the compensation driving circuit is configured to receive a light-emitting data signal, compensate a threshold voltage of the driving transistor, and drive the organic light-emitting diode to illuminate in accordance with the light-emitting data signal;

a signal acquiring circuit connected with the compensation driving circuit and configured to acquire a gate voltage of the driving transistor; and a compensation controller, configured to receive the gate voltage of the driving transistor acquired by the signal acquiring circuit, wherein the compensation controller is further configured to:

receive the light-emitting data signal received by the compensation driving circuit, subtract a light-emitting voltage in the light-emitting data signal received by the compensation driving circuit from the gate voltage of the driving transistor to obtain the threshold voltage of the driving transistor.

* * * * *